United States Patent [19]

Ashton et al.

[11] Patent Number: 4,469,537

[45] Date of Patent: Sep. 4, 1984

[54] ALUMINUM ARMOR PLATE SYSTEM

[75] Inventors: Richard F. Ashton; David S. Thompson, both of Richmond, Va.

[73] Assignee: Reynolds Metals Company, Richmond, Va.

[21] Appl. No.: 507,687

[22] Filed: Jun. 27, 1983

[51] Int. Cl.[3] ..... C22C 21/06

[52] U.S. Cl. ..... 148/440; 148/11.5 A; 420/542; 420/545; 89/36 A

[58] Field of Search ..... 148/2, 11.5 A, 12.7 A, 148/440; 420/542, 543, 545; 72/365; 29/527.7; 109/49.5; 89/36 A

[56] References Cited

U.S. PATENT DOCUMENTS

| | | | |
|---|---|---|---|
| 1,856,615 | 5/1932 | Archer et al. | 420/542 |
| 1,910,656 | 5/1933 | Tullis et al. | 420/543 |
| 1,932,837 | 10/1933 | Wood | 420/542 |
| 1,932,846 | 10/1933 | Dean et al. | 420/542 |
| 1,932,856 | 10/1933 | Wood | 420/542 |
| 2,096,010 | 10/1937 | Sicha | 420/542 |
| 3,232,796 | 2/1966 | Anderson | 148/11.5 A |
| 3,502,448 | 3/1970 | Anderson et al. | 148/11.5 A |
| 3,560,269 | 2/1971 | Anderson | 148/11.5 A |
| 3,649,227 | 3/1972 | Fetzer et al. | 89/36 A |
| 4,284,437 | 8/1981 | Baba et al. | 148/11.5 A |

FOREIGN PATENT DOCUMENTS

| | | | |
|---|---|---|---|
| 1347 | 3/1931 | Australia . | |
| 11110 | 1/1980 | Japan | 148/11.5 A |

OTHER PUBLICATIONS

Alloy Digest, Sep. 1958, Aluminum 5456.

*Primary Examiner*—L. Dewayne Rutledge
*Assistant Examiner*—Robert L. McDowell
*Attorney, Agent, or Firm*—Alan M. Biddison

[57] ABSTRACT

Aluminum-magnesium-manganese alloy cold rolled to produce armor plate with improved ballistic properties.

16 Claims, 3 Drawing Figures

ALUMINUM ARMOR PLATE SYSTEM

BACKGROUND OF THE INVENTION

Armor plate of aluminum alloys has become established for specialized purposes where not only ballistic resistance, but also lightweight are important considerations. This is notably true in the case of armored military personnel carriers which operate on the ground but must be transportable by air. U.S. military specifications have been developed for such alloys, dealing with ballistic performance in terms of the speeds of two different kinds of projectiles fired at specified obliquities to the target. One of these is an armor piercing projectile (e.g., .30 caliber) designated "AP", characterized by a pointed leading end. The other is a fragment simulating projectile (e.g., 20 mm) designated "FS", characterized by a blunt leading end. The latter projectile tends to create flying fragments from the inner side of the armor plate, even when the projectile fails to penetrate the plate, so that speeds less than penetration speeds have to be considered for purposes of FS tests.

Experience shows that an armor alloy better than another for one kind of these projectiles may be worse for the other kind of projectile. Weldability (joining characteristics and joint performance) and corrosion resistance, which are also important considerations, may also vary for different alloys. Consequently, the general objective is to develop armor plate alloys having improved performance in dealing with both kinds of projectiles, while also achieving good weldability and corrosion resistance.

The aluminum armor alloys which have become most widely accepted are 5083 meeting the requirements of U.S. Military Specification MIL-A46027F (MR), and 7039 meeting the requirements of U.S. Military Specification MIL-A46063E. Alloy 5456 is listed in the former specification, but apparently has had little, if any, acceptance for armor plate purposes. These and all other four digit alloy designations herein are in accordance with alloy numbers and corresponding definitions registered by The Aluminum Association, Washington, D.C.

As shown in these military specifications, armor plate of alloy 7039 is considerably superior to armor plate of alloy 5083 for AP ballistic performance, but less so in FS ballistic performance. In fact, below 1.235 inch gauge, 7039 armor plate is rated below 5083 armor plate in FS ballistic performance, according to the military specifications. In any case, the generally favorable ballistic performance of 7039 armor plate is seriously offset by the fact that it is more susceptible to stress corrosion than 5083 armor plate, especially when welded into an armored structure. It is also less readily weldable than 5083 armor plate, and is more dense than 5083 armor plate, due to the relatively high magnesium and low zinc content of 5083.

Accordingly, there has remained a need for an improved aluminum-based armor plate which attains the best of the AP and FS ballistic performances of 7039 and 5083 plate while also attaining the good qualities of 5083 plate as regards corrosion resistance, weldability and light weight.

SUMMARY OF THE INVENTION

We have discovered that above a certain relatively high level of magnesium and manganese content of aluminum armor alloys, additional increments of magnesium and manganese produce surprisingly high gains in ballistic resistance over a wide range of cold rolled reduction of aluminum armor plate. We have further discovered that it is feasible to cold roll plate of such alloys to reductions so great as to raise the AP and FS ballistic performance characteristics of the plate above the levels required for 5083 and 7039 alloy plate to meet the applicable military specifications cited above. The resultant plate also has favorable welding and corrosion capabilities, and relatively low density due to its high magnesium content.

For purposes of the invention, the alloy content of magnesium is in the range of about 5.0 to 6.5% (preferably about 5.3 to 5.7%), and of manganese is in the range of about 0.60 to 1.20% (preferably about 0.70 to 1.05%), and the total of magnesium and manganese is in the range of about 0.6 to 6.7%. All alloy constituent percentages herein are by weight. Furthermore, the lower limit of the cold rolled reduction of the plate is at least about 19%, and preferably more than 23%, while the preferred range of cold rolled reduction is about 26 to 32%.

BRIEF DESCRIPTION OF THE DRAWINGS

The accompanying drawings show illustrative graphs, as follows.

DETAILED DESCRIPTION OF PRESENT PREFERRED EMBODIMENTS

The mill practices used in making the armor plate of the invention substantially follow those conventionally used in making 5083 armor plate, beginning with direct chill casting of an ingot, allowing the ingot to cool to ambient temperature, scalping and reheating the ingot, starting to roll the reheated ingot soon enough to avoid precipitation of dissolved magnesium and manganese, hot rolling and then cold rolling to the desired degree of cold rolled reduction, and stretching the cold rolled plate to flatten it. Edge cracks developed in the course of rolling are removed by trimming.

The significant alloying constituents for purposes of the invention are magnesium and manganese in an aluminum base. The alloy may also contain impurities or minor constituents of other elements, such as 0.27% iron, up to about 0.40% silicon, 0.2% chromium, 0.75% zinc, 0.15% titanium, 0.10% copper, 0.15% zirconium, others each 0.05%, and others total 0.15%. It is preferable to add chromium to retard recrystallization thereby improving strength of the alloy. It also is desirable to include titanium to provide fine grain during casting. Zinc, while not included in the presently preferred embodiment of the invention, should be helpful to improve corrosion resistance. Zirconium, also not included in the presently preferred embodiment, should further enhance grain structure control.

For purposes of the invention, the amount of magnesium in the alloy is required to be about in the range of 5.0 to 6.5%, preferably 5.3 to 5.7%, the amount of manganese is required to be about in the range of 0.60 to 1.20%, preferably 0.70 to 1.05%, and the total magnesium and manganese is required to be about in the range of 6.0 to 6.7%.

Figure 1:
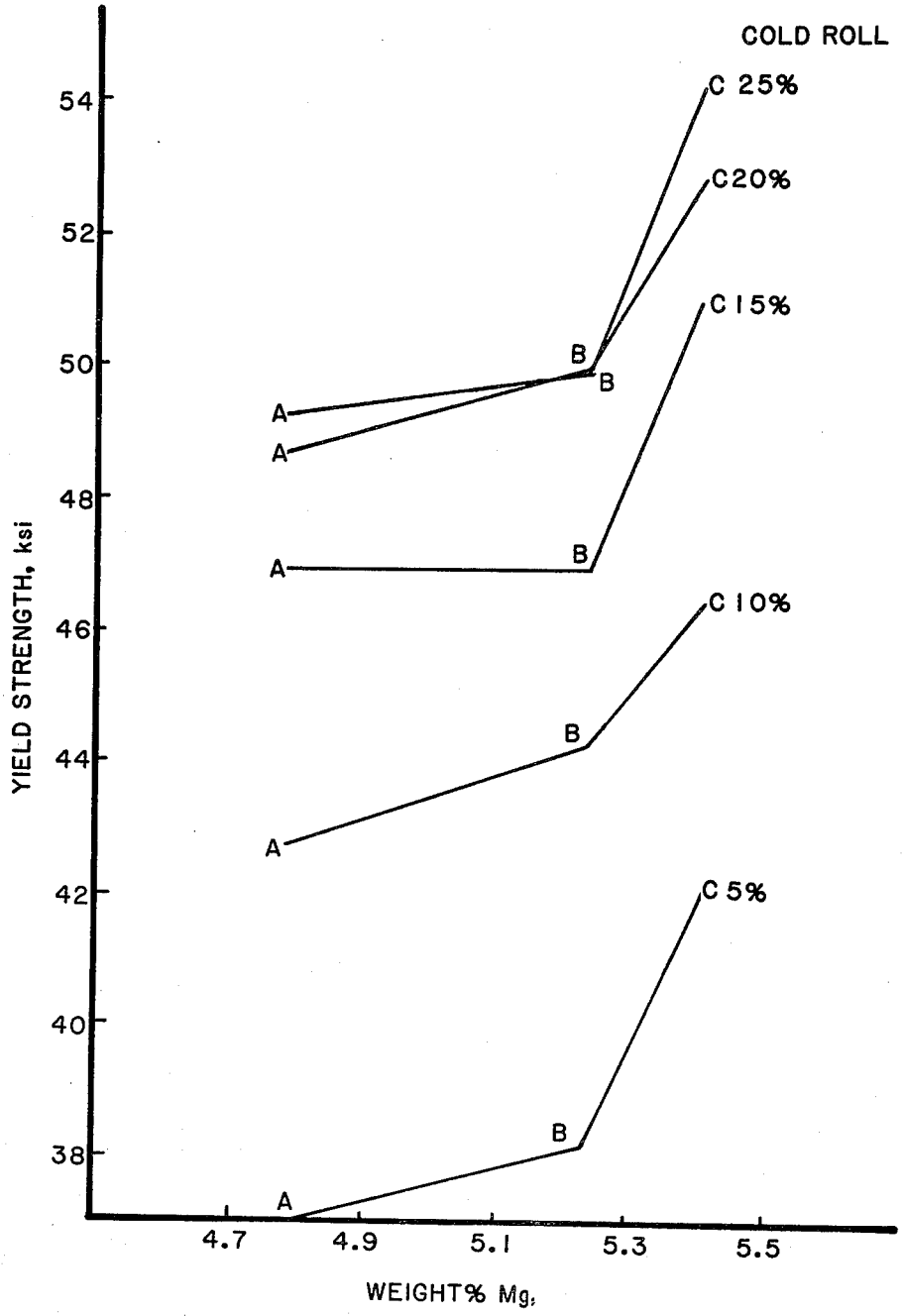
FIG. 1 shows yield strength properties plotted against magnesium content, for various levels of cold rolled reduction.
Figure 2:
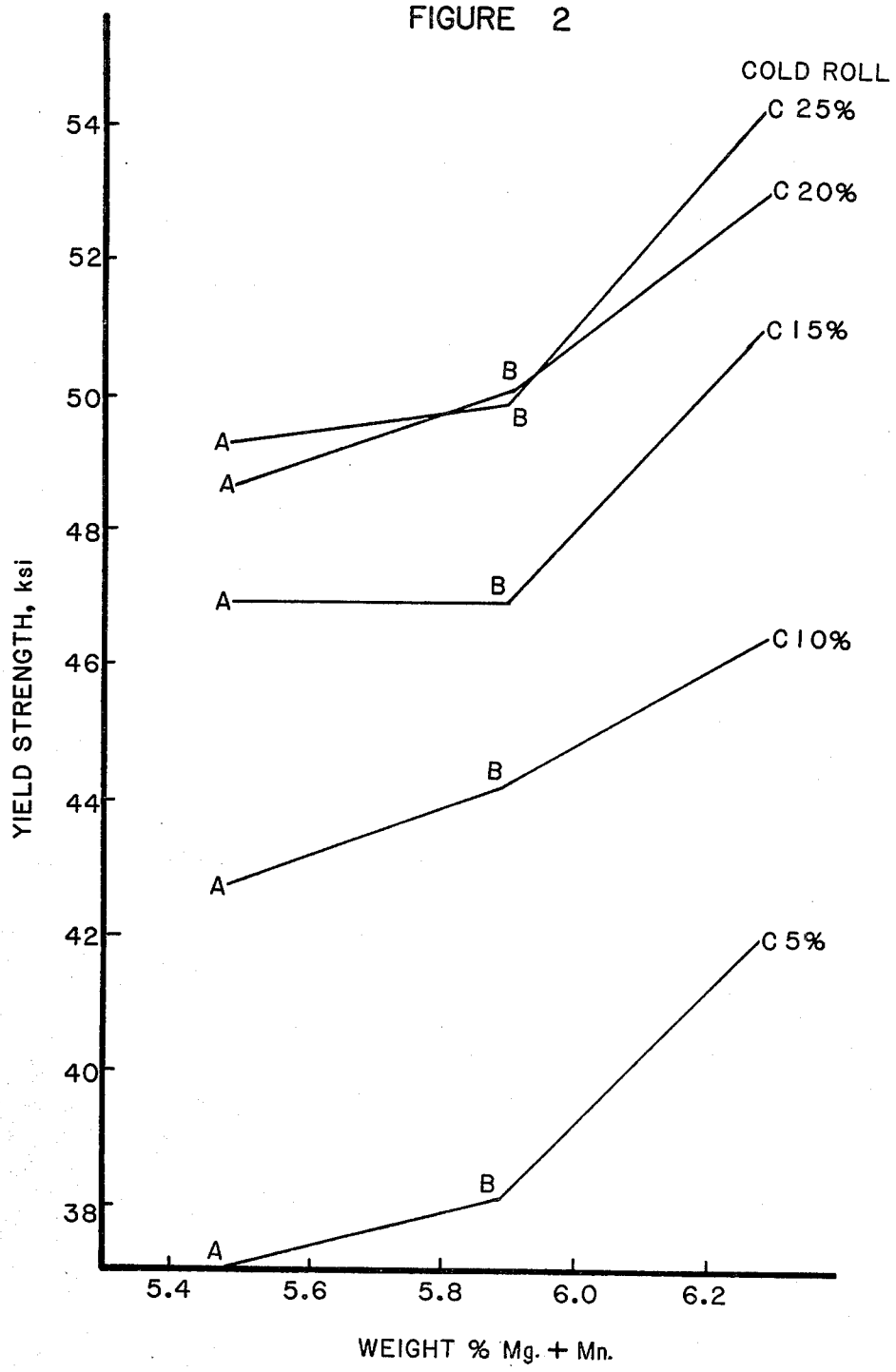
FIG. 2 shows yield strength properties plotted against combined magnesium and manganese content, at various cold rolled levels.

The significance of this relatively high content of magnesium and manganese is illustrated in FIGS. 1 and 2, which show the improvement in yield strength (which generally tends to correlate directly with AP ballistic performance) obtainable by raising the magnesium content (FIG. 1) and a combined magnesium and manganese content (FIG. 2). These figures compare three alloy examples, the alloy A on the left being a typical 5083 alloy having the least magnesium and manganese content, the alloy B in the center being a typical 5456 alloy, having an intermediate content of magnesium and manganese, and the alloy C on the right being an alloy in accordance with the invention, having a relatively high level of magnesium and manganese. The compositions of these alloys were as follows:

TABLE 1

| Alloy | Mg | Mn | Si | Fe | Cu | Cr | Zn | Ti |
|---|---|---|---|---|---|---|---|---|
| A (5083) | 4.78 | 0.71 | 0.12 | 0.30 | 0.09 | 0.10 | 0.03 | 0.02 |
| B (5456) | 5.24 | 0.65 | 0.11 | 0.29 | 0.09 | 0.08 | 0.02 | 0.02 |
| C (Invention) | 5.41 | 0.86 | 0.10 | 0.29 | 0.09 | 0.09 | 0.02 | 0.02 |

Each of the alloys A, B and C was cast, hot and cold rolled, and stretched in a laboratory to produce about one inch gauge plate for testing. The plate was rolled to successive levels of substantially 5%, 10%, 15%, 20% and 25% reduction, and tested for yield strength to obtain the comparisons shown in FIGS. 1 and 2. It is clear from these figures that the increase of magnesium and manganese levels in the alloy C of the invention shown at the right, as compared to the 5456 alloy B shown in the center, produces a surprisingly strong effect on yield strength, and thus of general ballistic resistance properties, as compared to the much smaller increase in yield strength resulting from the corresponding difference in magnesium and manganese contents between the 5083 alloy A shown at the left as compared with the 5456 alloy B shown in the center.

Figure 3:
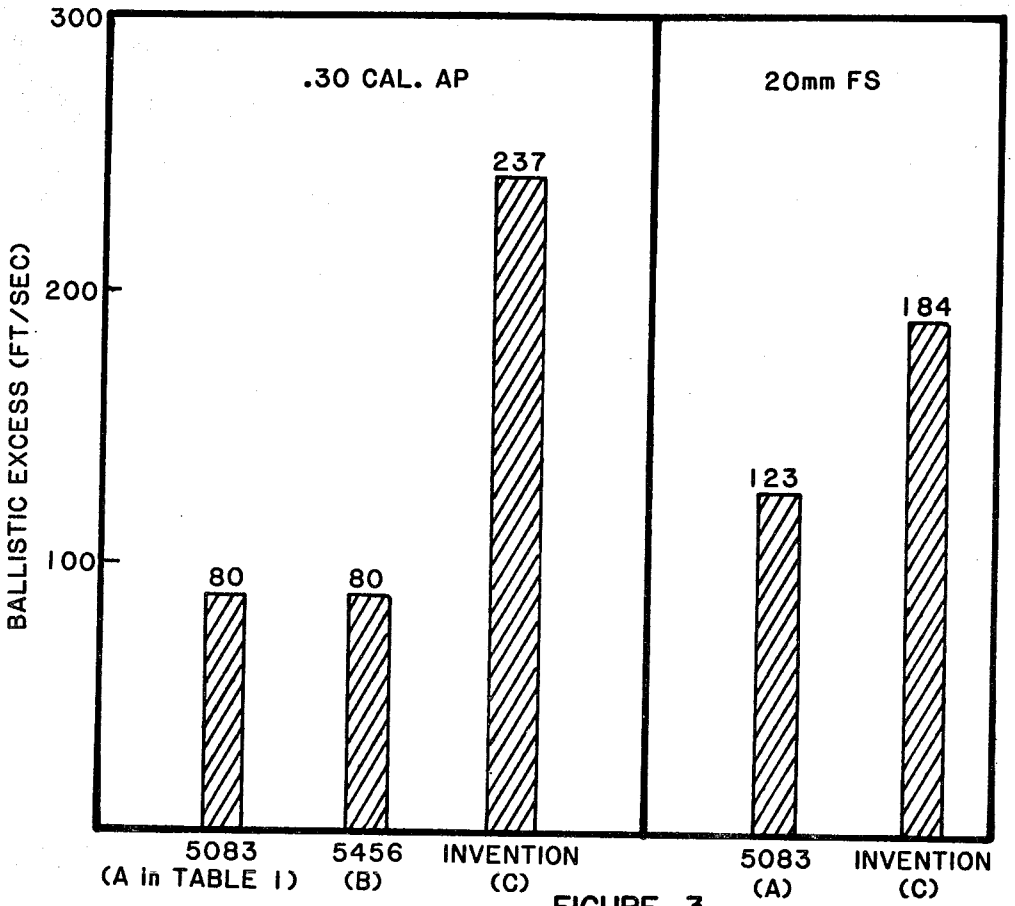
FIG. 3 shows certain ballistic excess figures for examples of armor plate of the invention and of armor plate of conventional alloys.

The improved ballistic properties implied by the yield strength properties shown in FIGS. 1 and 2 are confirmed by the ballistic excess test results shown in FIG. 3, which also shows improved fragment simulator values of the invention as compared to 5083 alloy plate (alloy A). The results shown in FIG. 3 were computed by determining the ballistic limit speed in feet-per-second required to penetrate plate of specimens of the A, B and C alloys; and from that speed in each case subtracting the applicable minimum projectile speed requirement of the military specification covering 5083 and 5456 aluminum armor plate. The ballistic limit was determined in accordance with procedures specified by the aforementioned military specifications, which takes into account the actual gage of the plate. The alloy A (5083) specimen was 0.995 inches thick after 18.2% cold rolling; the alloy B (5456) specimen was 0.993 inches thick after 20.2% cold rolling; and the alloy C (invention) specimen was 1.178 inches thick after 18.6% cold rolling.

Although high magnesium and manganese levels are essential for the purposes of the invention, it is also important to cold roll to sufficiently high reductions to achieve the objective of obtaining ballistic resistance levels above those required by military specifications for 5083 and 7039 aluminum armor plate. The effects of cold rolled reduction levels on the ballistic properties of alloys of the invention are illustrated in the following table of test results of seven specimens of plate:

TABLE 2

| Test Plate No. | Gauge (Inch) | % Cold Rolled Reduction | Longitudinal Properties UTS (ksi) | YS (ksi) | % Elong. | Ballistic Excess, ft/sec Over 5083 min. .30 Cal. AP | 20 mm FS | Over 7039 min. .30 Cal. AP | 20 mm FS |
|---|---|---|---|---|---|---|---|---|---|
| 1 | 1.540 | 16.8 | 56.9 | 48.2 | 10.5 | +244 | +258 | −10 | +32 |
| 2 | 1.516 | 19.1 | 56.2 | 49.1 | 9.3 | +265 | +234 | +12 | −4 |
| 3 | 1.430 | 22.7 | 59.2 | 52.4 | 8.3 | +250 | +319 | +1 | +159 |
| 4 | 1.384 | 23.1 | 58.7 | 51.4 | 9.8 | +271 | +262 | +24 | +39 |
| 5 | 1.497 | 26.5 | 60.6 | 57.2 | 6.8 | +269 | +272 | +17 | +53 |
| 6 | 1.452 | 27.7 | 60.1 | 57.1 | 7.8 | +276 | +306 | +26 | +127 |
| 7 | 1.487 | 30.2 | 59.6 | 56.5 | 5.8 | +280 | +317 | +28 | +116 |

The first column in the table identifies the plate specimen by an arbitrary number, the next column gives the final thickness of the plate, and the next column after that gives the percentage of cold rolled reduction. Next are columns showing ultimate tensile strength (UTS) and yield strength (YS), in thousand pounds per square inch tensile load, and then a column for percentage elongation in a 2 inch gage length at fracture. Finally, there are four columns on ballistic performance, in terms of ballistic limit speed of AP and FS projectiles which the specimen can withstand, expressed first in terms of that speed less the minimum speed under Military Specification MIL-A-46027F (MR) for 5083 armor plate of like thickness for each of the two kinds of projectiles fired at zero degrees obliquity, and then expressed in the last two columns in terms of the same said speed less the minimum speed under Military Specification MIL-A-46063E for 7039 armor plate of like thickness for each of the two kinds of projectiles fired at zero degrees obliquity.

The plate specimens of Table 1 were rolled from ingots of 7 to 8 tons which were cast vertically by the direct chill process. Both the casting and the rolling were performed in industrial plant equipment which makes commercial 5083 and 7039 aluminum armor plate. The plate specimens 1 and 2 were rolled from one ingot, specimens 3 and 4 were rolled from a second ingot from a different casting drop, and the remaining specimens 5, 6 and 7 were rolled from a third ingot from the same drop as the second ingot. The percentage compositions of these ingots were as follows, balance aluminum:

TABLE 3

| Ingots: | Mg | Mn | Si | Fe | Cu | Cr | Zn | Ti |
|---|---|---|---|---|---|---|---|---|
| First | 5.56 | 0.79 | 0.09 | 0.27 | 0.06 | 0.09 | 0.05 | 0.02 |
| Second | 5.48 | 0.81 | 0.11 | 0.27 | 0.09 | 0.09 | 0.06 | 0.02 |

TABLE 3-continued

| Ingots: | Mg | Mn | Si | Fe | Cu | Cr | Zn | Ti |
|---|---|---|---|---|---|---|---|---|
| Third | 5.51 | 0.79 | 0.09 | 0.27 | 0.06 | 0.09 | 0.05 | 0.02 |

The military specifications set minimum values for projectile velocities which must be withstood by the aluminum armor plate being tested, and some degree of excess resistance is desirable to avoid the possibility of occasional failure to meet specifications in the course of producing successive production runs. Accordingly, it is concluded that for purposes of reliably obtaining AP and FS ballistic properties better than the minimum requirements for 5083 and 7039 armor plate, the plate of the invention should receive a cold rolled reduction in the preferred range of 26 to 32%. However, it is possible to achieve such ballistic properties with cold rolled reductions as low as about 19%, although a minimum cold rolled reduction above 23% would be preferable as more reliable for production purposes.

Stress corrosion tests were run on the plates identified in Table 2 using the ASTM G44 Alternate Immersion procedure. This involves immersing stressed samples in a 3.5% NaCl solution (made with distilled water) for 10 minutes in each hour, followed by 50 minutes drying in air. This cycle is then repeated for the duration of the test, usually 30 days. The "C" ring specimens were cut from the plate in the manner described in ASTM G38 and then stressed to 30 KSI in the short transverse (through the plate thickness) direction. This test direction is selected since aluminum alloys are most susceptible to stress corrosion in this direction. The Table 2 plate specimens passed this standard corrosion test exhibiting no failures even after 90 days testing, which corresponding specimens of 5083 and 5456 alloys would also be expected to pass. 7039 armor plate, on the other hand, usually fails this test within 30 days.

Welding tests were made by gas metal arc welding plates and tensile testing specimens machined from the plates. The test results are shown in the following Table 4:

TABLE 4

| Alloy | Nominal Gauge, Inch | Filler | UTS, KSI | YS, KSI | % Elong. in 2" | % Joint Eff. |
|---|---|---|---|---|---|---|
| Invention | 1.50 | 5356 | 46 | 28 | 12 | 82 |
| 5083 | 1.50 | 5356 | 41 | 22 | 14 | 79 |
| 7039 | 1.25 | 5356 | 45 | 31 | 11 | 68 |

The results shown in Table 4 indicate that the alloy of the invention has good welding properties. The tested alloy of the invention was the second plate in Table 2. The tests were made in accordance with Section IX of the ASME Boiler and Pressure Vessel Code. The ultimate tensile strength, yield strength and elongation properties shown in Table 4 are across the weld joint.

While examples of the practice of the invention have been illustrated and described, it will be understood that it may be otherwise variously embodied and practiced within the scope of the following claims.

We claim:

1. A method of producing improved aluminum alloy armor plate, comprising:

A. Providing an ingot consisting of about 5.0 to 6.5% magnesium and about 0.60 to 1.20% manganese, the total of magnesium and manganese being in the range of about 6.0 to 6.7%, the balance being aluminum and impurities and incidental elements;

B. Hot rolling the ingot into plate; and

C. Cold rolling said plate to a cold rolled reduction of at least about 19%.

2. The method of claim 1, in which the cold rolled reduction is at least 23%.

3. The method of claim 1, in which the cold rolled reduction is in the range of about 26 to 32%.

4. The method of claim 1, in which the magnesium content of the ingot is about 5.3 to 5.7% and the manganese content is about 0.70 to 1.05%.

5. The method of claim 4, in which the cold rolled reduction is at least 23%.

6. The method of claim 4, in which the cold rolled reduction is in the range of about 26 to 32%.

7. The method of claim 1, further comprising stretching the cold rolled plate to flatten the plate.

8. Armor plate made in accordance with claim 1.

9. Armor plate made in accordance with claim 2.

10. Armor plate made in accordance with claim 3.

11. Armor plate made in accordance with claim 4.

12. Armor plate made in accordance with claim 5.

13. Armor plate made in accordance with claim 6.

14. A method of producing improved aluminum alloy armor plate, comprising:

A. Providing an ingot consisting of up to about 0.2% chromium, up to about 0.15% titanium, about 5.0 to 6.5% magnesium and about 0.60 to 1.20% manganese, the total of magnesium and manganese being in the range of about 6.0 to 6.7%, the balance being aluminum and impurities and incidental elements;

B. Hot rolling the ingot into plate; and

C. Cold rolling said plate to a cold rolled reduction of at least about 19% to thereby raise the ballistic performance characteristics of said plate.

15. The method of claim 14, further comprising stretching the cold rolled plate to flatten the plate.

16. Armor plate made in accordance with claim 15.

* * * * *